US008393529B2

(12) United States Patent
Volz et al.

(10) Patent No.: US 8,393,529 B2
(45) Date of Patent: Mar. 12, 2013

(54) EZ-FOLD MODULAR PIZZA BOX

(76) Inventors: William Gerard Volz, Wake Forest, NC (US); Brady Neal Ware, Wilmington, NC (US)

( * ) Notice: Subject to any disclaimer, the term of this patent is extended or adjusted under 35 U.S.C. 154(b) by 138 days.

(21) Appl. No.: 12/070,591

(22) Filed: Feb. 20, 2008

(65) Prior Publication Data

US 2008/0197177 A1 Aug. 21, 2008

Related U.S. Application Data

(60) Provisional application No. 60/902,486, filed on Feb. 20, 2007.

(51) Int. Cl.
*B65D 5/54* (2006.01)
*B65D 21/08* (2006.01)

(52) U.S. Cl. ..... 229/101.2; 229/235; 229/239; 229/906

(58) Field of Classification Search ..... 229/101, 229/101.1, 101.2, 235, 239, 902, 906, 936, 229/931

See application file for complete search history.

(56) References Cited

U.S. PATENT DOCUMENTS 1,288,132 A * 12/1918 Nagle ..... 229/931
1,652,748 A 12/1927 Terwilliger et al.
2,967,010 A 1/1961 Cuffey et al.
2,985,075 A * 5/1961 Knutsson-Hall ..... 229/931
3,094,267 A * 6/1963 Boitel ..... 229/235
3,167,240 A * 1/1965 Collura et al. ..... 229/101.2
3,285,496 A * 11/1966 Barnhardt, Sr. et al. ..... 229/211
3,302,855 A 2/1967 Becker
3,465,946 A * 9/1969 Johnson ..... 206/521
4,111,306 A * 9/1978 Roccaforte ..... 229/240
4,237,171 A 12/1980 Laage et al.
4,502,514 A * 3/1985 Ballard et al. ..... 229/240
4,621,736 A * 11/1986 Roccaforte ..... 229/101.1
5,071,062 A 12/1991 Bradley et al.
5,098,757 A * 3/1992 Steel ..... 428/34.2
5,110,038 A * 5/1992 Pantisano et al. ..... 229/103
5,135,790 A * 8/1992 Kaplan et al. ..... 428/77
5,209,392 A * 5/1993 Anatro ..... 229/906
5,273,206 A 12/1993 Vassiliou
5,375,761 A * 12/1994 Sullivan et al. ..... 229/100
5,702,054 A 12/1997 Phillips et al.
5,836,451 A * 11/1998 Dixon ..... 206/569
6,109,512 A 8/2000 Morrison
6,336,584 B1 * 1/2002 Roch et al. ..... 229/101.2
6,375,066 B1 4/2002 Ritter
6,440,050 B1 * 8/2002 Capparelli et al. ..... 493/59
6,547,125 B2 4/2003 Correll
6,676,009 B1 1/2004 Rose (Continued)

FOREIGN PATENT DOCUMENTS

EP 1 593 606 A2 9/2005

*Primary Examiner* — Gary Elkins
(74) *Attorney, Agent, or Firm* — Brady Neal Ware

(57) ABSTRACT

The present invention provides an easily disposable pizza box that may also be used as a storage container for holding leftover pizza. In the most preferable embodiment, a pull-tab cord design is used as the primary means of weakening the box structure, which facilitates separating the first box into two portions. The resulting open end of one or both portions may be readily folded shut, thereby forming a second closed box structure. In a preferred embodiment of the present invention, one portion of the split first box is sized so that when the open end is folded shut, the second box is essentially half the volume of the first box.

13 Claims, 8 Drawing Sheets

U.S. PATENT DOCUMENTS

Figure 1:
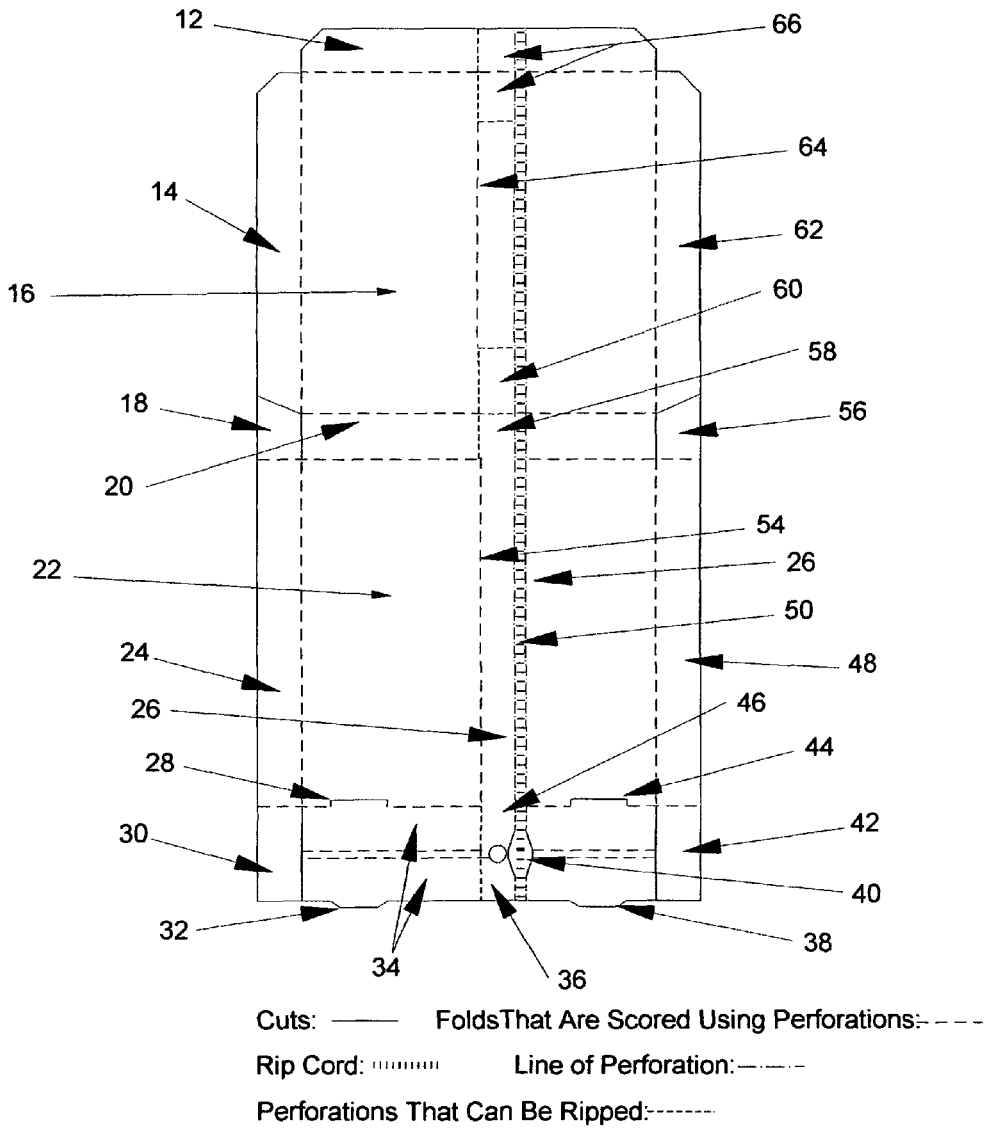

| | | | | |
|---|---|---|---|---|
| 7,051,919 | B1 * | 5/2006 | Walsh | 229/103 |
| 2003/0047593 | A1 * | 3/2003 | Correll | 229/906 |
| 2003/0201316 | A1 | 10/2003 | Manninen | |
| 2005/0150938 | A1 | 7/2005 | Correll | |
| 2005/0189406 | A1 * | 9/2005 | Welchel et al. | 229/235 |
| 2006/0054676 | A1 * | 3/2006 | Wischusen | 229/235 |
| 2006/0255106 | A1 * | 11/2006 | Green | 229/101.2 |
| 2007/0267471 | A1 | 11/2007 | Falana | |

* cited by examiner

Cuts: ——— FoldsThat Are Scored Using Perforations:- - - -

Rip Cord: ''''''''''' Line of Perforation: — — —

Perforations That Can Be Ripped:-------

Cuts: ——— FoldsThat Are Scored Using Perforations: - - -

Rip Cord: ||||||||| Line of Perforation: — — —

Perforations That Can Be Ripped: - - - - - -

Cuts: ——— FoldsThat Are Scored Using Perforations: - - -

Rip Cord: ''''''''''' Line of Perforation: — — —

Perforations That Can Be Ripped: - - - - - -

Cuts: ——— FoldsThat Are Scored Using Perforations:- - - -

Rip Cord: ''''''''''' Line of Perforation:—·—·-

Perforations That Can Be Ripped:-------

Cuts: ——— FoldsThat Are Scored Using Perforations: - - - -

Rip Cord: ''''''''''' Line of Perforation: — · — ·

Perforations That Can Be Ripped: - - - - - - -

Cuts: ——— FoldsThat Are Usually Scored: - - - -

Rip Cord: ''''''''''' Line of Perforation: – – – –

Perforations That Can Be Ripped:------

Folds That May Or May Not Be Scored: .....

EZ-FOLD MODULAR PIZZA BOX

CROSS-REFERENCE TO RELATED APPLICATIONS

This application claims priority from application No. 60/902,486 filed on Feb. 20, 2007.

STATEMENT REGARDING FEDERALLY SPONSORED RESEARCH OR DEVELOPMENT

N/A

REFERENCE TO SEQUENCE LISTING, A TABLE, OR A COMPUTER PROGRAM LISTING COMPACT DISK APPENDIX

N/A

BACKGROUND OF THE INVENTION

Pizza delivery is a multi-billion dollar industry. The growth of the business has kept pace with the development of suitable containers for carrying the pizza. The modern pizza delivery box such as that used by the large retail chain stores is, in many ways, the ideal delivery system. In order to be an ideal delivery system, the boxes must possess a combination of traits. The boxes must keep the pizza warm, be sturdy enough to withstand the delivery process, and be inexpensive to manufacture. Boxes known in the art achieve each of these characteristics. One example is that disclosed in U.S. Pat. No. 5,702,054.

Although boxes found in the art are nearly ideal delivery vehicles for getting the product to the customer, none successfully address post-delivery customer needs. More specifically, most boxes found in art present a disposal problem. Pizza boxes are typically larger than indoor household trash receptacles. In order to dispose of the box, customers must crush or tear the box in order to reduce its size so that it may easily fit into a household trash receptacle. Additionally, the box is typically too large to easily fit into the household refrigerator for storing leftover pizza.

The subject of several patents is the improvement of the typical pizza box to help alleviate these shortcomings. For example, U.S. Pat. Nos. 5,273,206 and 5,197,659 disclose pizza box designs incorporating score-lines designed to facilitate rolling the pizza box into a cylindrical shape when empty for ease of disposal. U.S. Pat. No. 5,305,949 discloses a pizza box incorporating removable punch-out sections and weakening lines, which facilitate folding the box in half for ease of disposal. U.S. Pat. No. 5,209,392 discloses a box incorporating a transverse perforation, which facilitates breaking the box in two for ease of disposal. Each of the foregoing patents address the need for making the box more easily disposable but do not address leftover storage needs. In addition, each of these designs incorporate extensive score-lines or perforations that are needed to make the box more easily disposable but also significantly weaken the structural integrity of the box during the delivery process. None of these designs incorporate means for selectively weakening the structural integrity of the box by the consumer post-delivery. Additionally, these designs are complex, and may prove difficult to use by many consumers.

Other patents address both ease of disposal and the need to have a box that can accommodate multiple volumes. U.S. Pat. No. 5,071,062 discloses a box incorporating perforated score lines so that the top portion may be ripped off while the bottom portion of the box is retained and folded into a second enclosed box structure for the storage of left over pizza. U.S. Pat. No. 6,375,066 discloses a box design incorporating transverse perforation lines through the lid and bottom portions of the box and an additional fold line which together facilitate breaking the box in two and folding the open end shut for use as a secondary storage container. U.S. Pat. No. 7,051,919 discloses a box incorporating perforations and score lines, which facilitate the removal of multiple pieces of the original box and the folding of the remainder of the box into a tapered box structure for the storage of leftover pizza. However, each of these designs utilize extensive perforations and score lines that significantly weaken the box structure while none incorporate means for selectively weakening the structural integrity of the box by the consumer post-delivery. Further, these designs are also complex, and may prove difficult to use by many consumers. Additionally, none disclose means for easily storing an entire half pizza as leftovers.

BRIEF SUMMARY OF THE INVENTION

The present invention overcomes the shortcomings of the prior art and provides an easily disposable pizza box that may also be used as a storage container for holding leftover pizza. The present invention incorporates means for reducing the size of the box structure by first splitting the box into two overall pieces (the splitting means). This facilitates disposal of the box in household trash receptacles. Optionally, a portion of the split box may be folded shut generating a second closed box structure that may be used to store leftovers. The present invention most preferably utilizes a pull-tab cord design as the primary means of weakening the box structure to facilitate separating the overall box into two portions. However, perforations may be used as a substitute for the pull-tab cord. Further, perforations may be used in addition and in conjunction with the pull-tab cord in order to facilitate cleaner edges when the box is torn apart and or to reduce the effort required to tear the box in two. Depending upon the exact placement of the splitting means, the halves may or may not be equal in size. Further, the resulting open ends of one or both of the resulting halves may incorporate preformed score lines and or perforations that facilitate folding the open end shut, thereby forming a second closed box structure. In a preferred embodiment of the present invention, one portion of the split box is sized so that when the open end is folded shut, the second closed box is essentially half the volume of the first original box. By most preferably incorporating a destructive pull-tab cord design instead of extensive preformed perforations as the primary means of weakening the box structure, the structural integrity of the box is not significantly weakened as compared to the typical pizza box until the customer chooses to pull the tab in order to split the first box for disposal or store leftover pizza by folding one of the split portions of the first box closed generating a second box. Further, the present invention incorporates a simplified design that is easy for a consumer to use. The present invention incorporates means whereby the consumer, after splitting the first box, may optionally generate the second closed box without first opening the lid.

In summary, the present invention provides for a sturdy delivery vehicle that incorporates means for splitting the first box into two portions to facilitate disposal and or storage of leftovers. Further, in a preferable embodiment, the split box is designed so the opened end of one portion may be folded closed, generating a sturdy storage container that may be used to store leftovers. Further, in the most preferable embodiment, the split box is designed so the end of the larger portion may be folded closed, generating a sturdy storage container that may be used to store a full half pizza of leftovers. Food containers incorporating the present invention are easy to use and economical to manufacture.

BRIEF DESCRIPTION OF THE SEVERAL DRAWINGS

Figure 2:
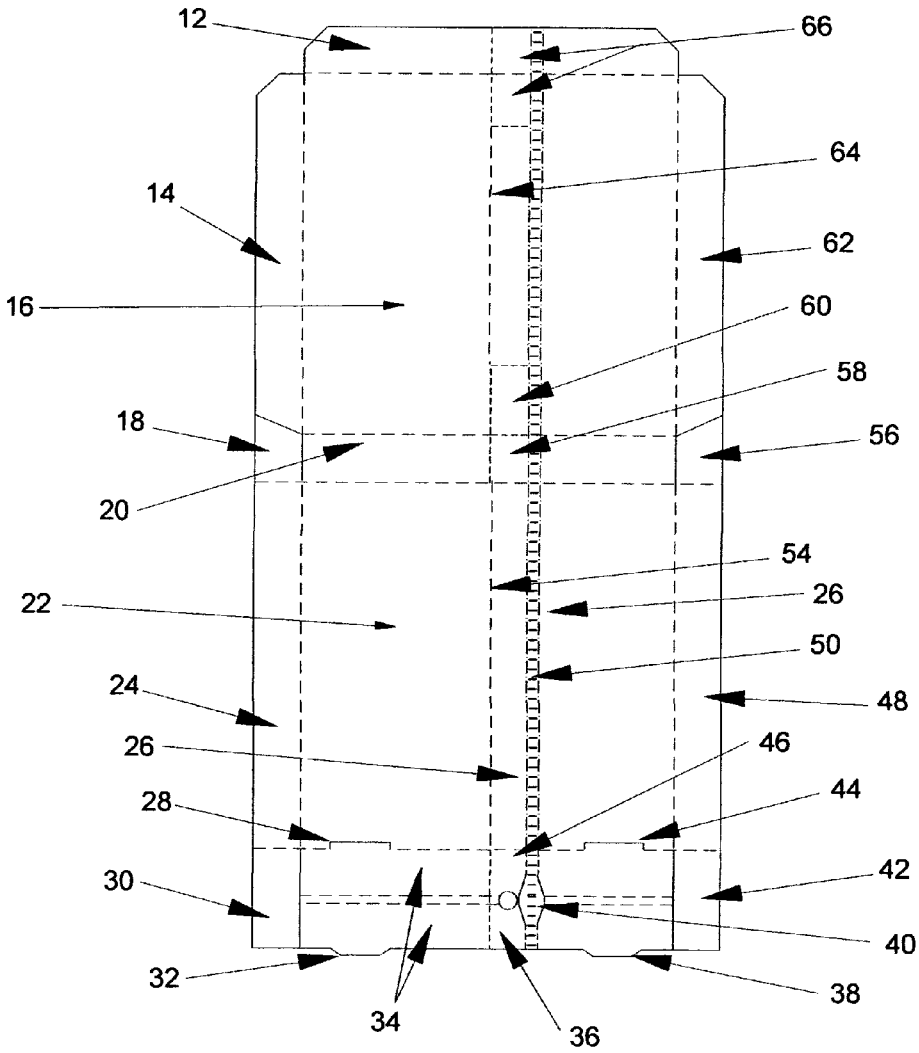
Figure 3:
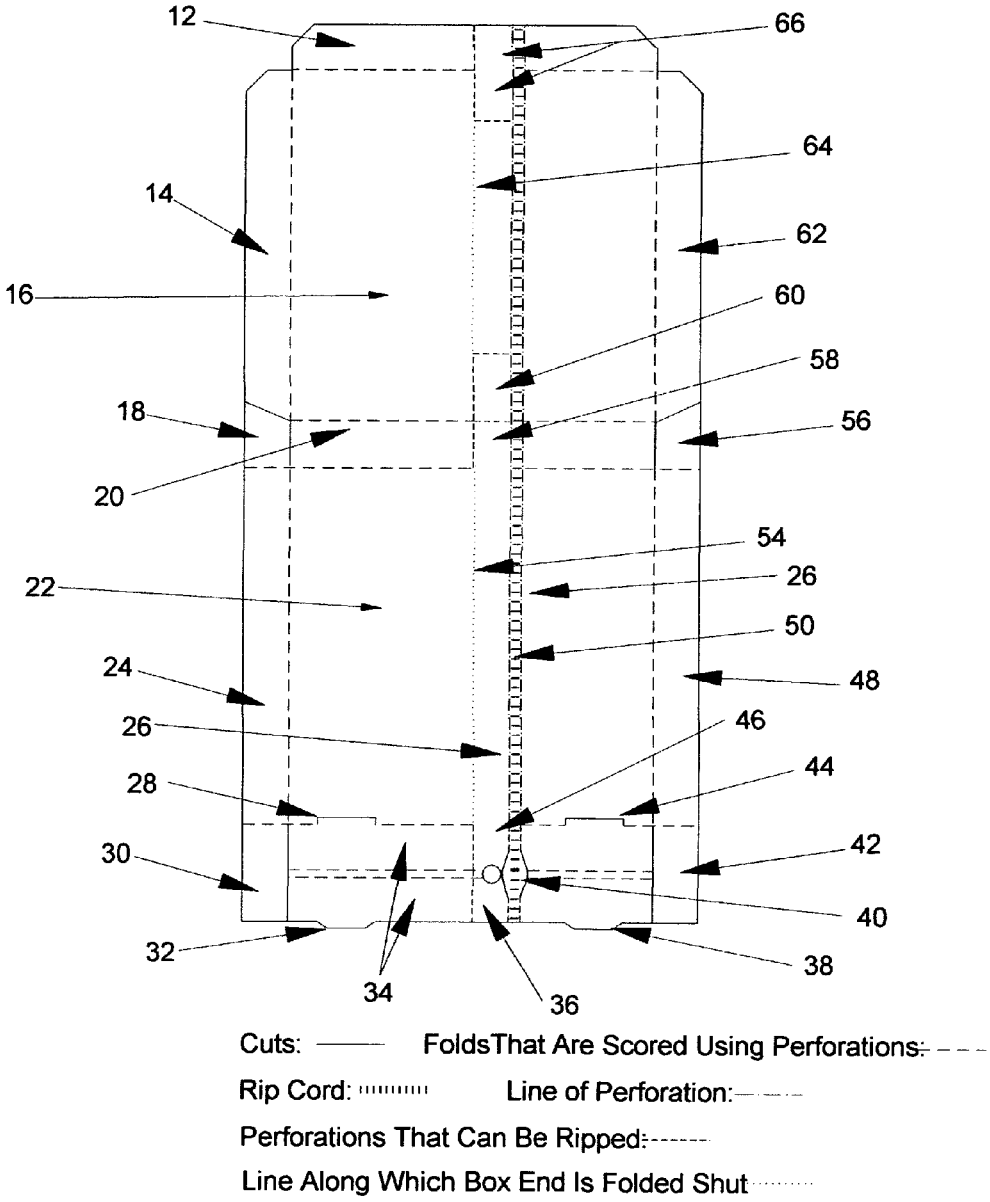
Figure 4:
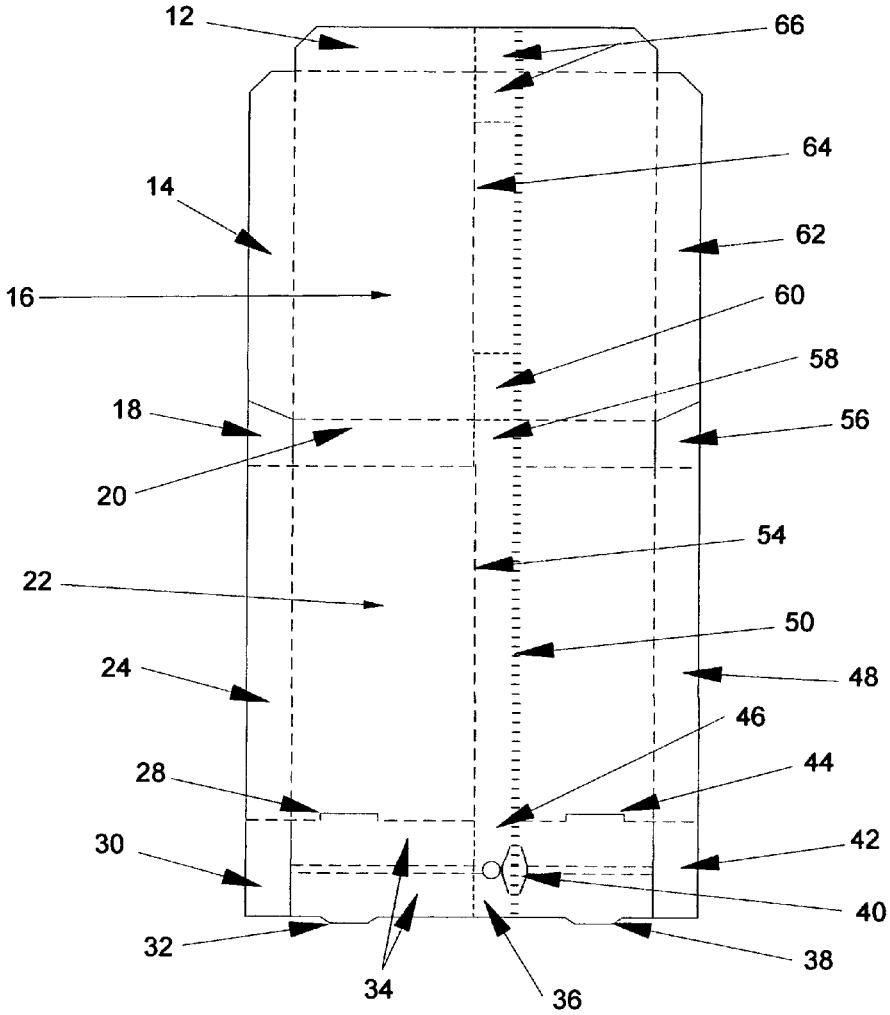
Figure 5:
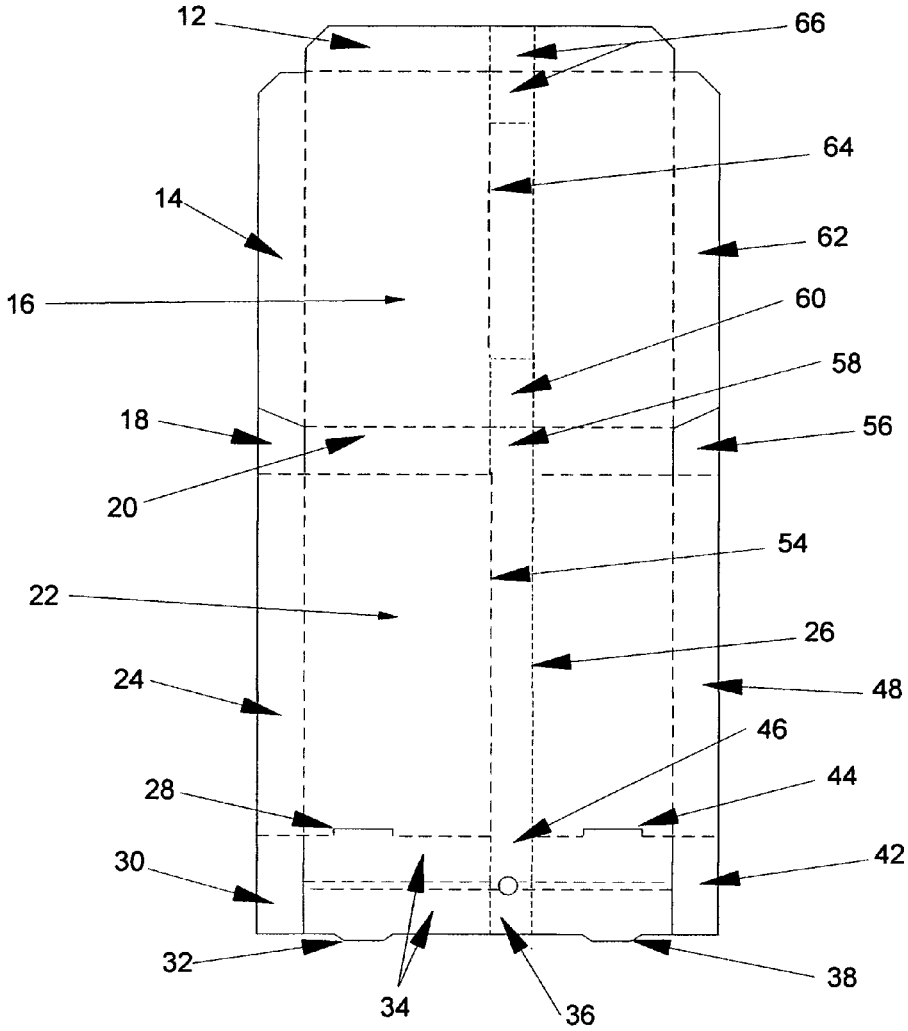
Figure 6:
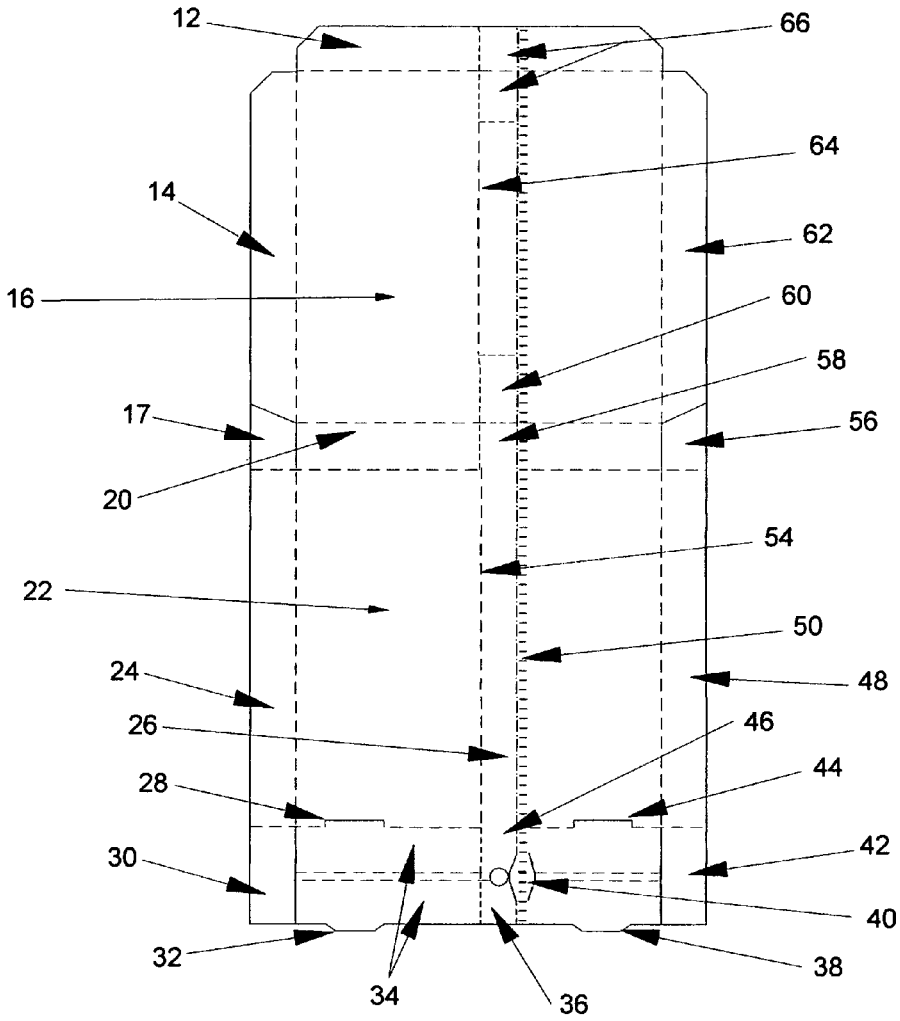
Figure 7:
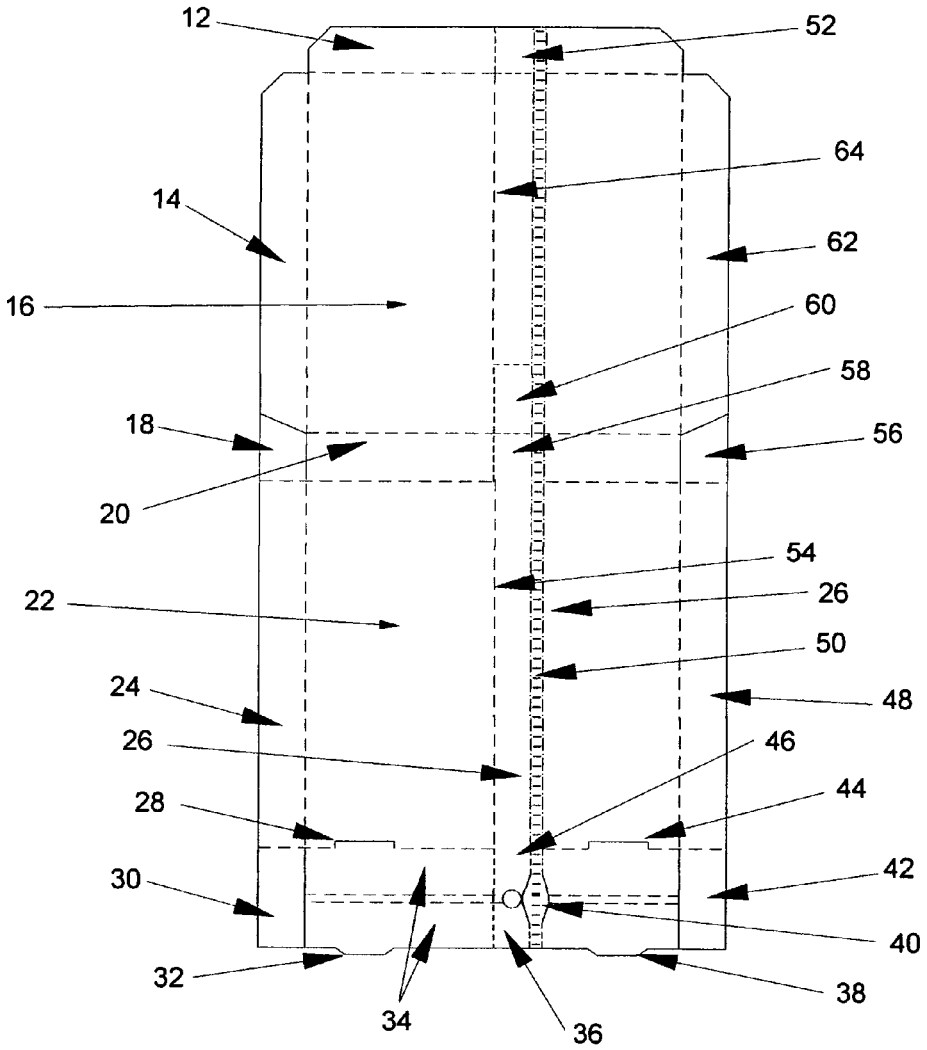
Figure 8:
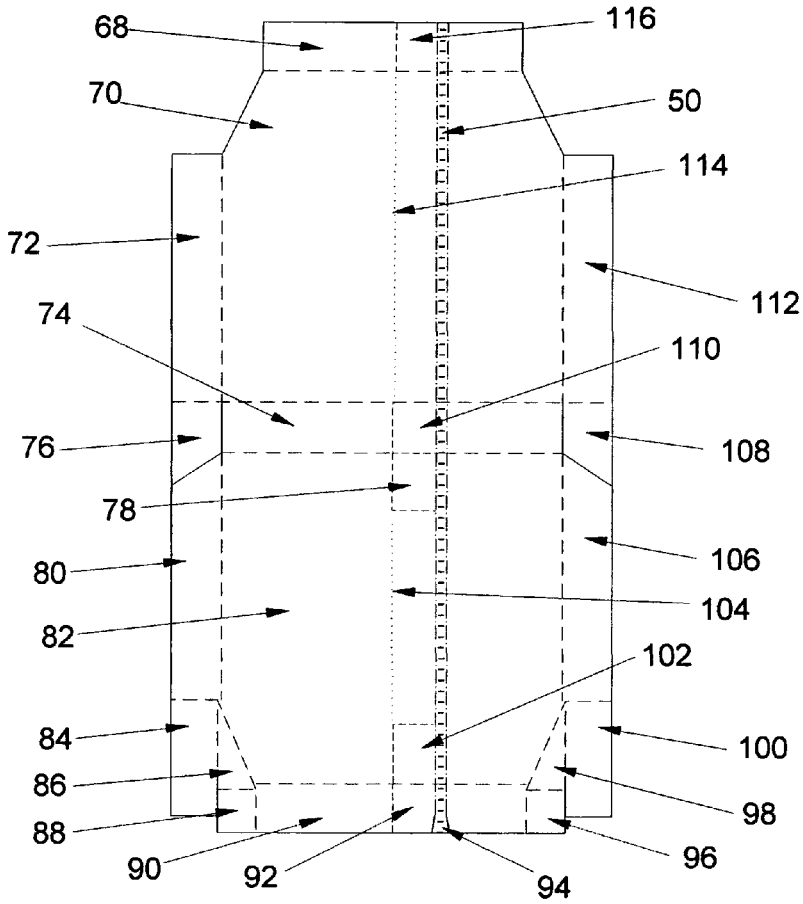

FIG. 1 is a plan view of one embodiment of the present invention illustrating how a sheet of material such as cardboard may be cut and folded into a container according to the present invention. This particular embodiment of the present invention utilizes a design whereby the sides defining the Top, 16, of the box fold inside of the sides defining the Bottom, 22, of the box when the box is closed. FIG. 2 is a plan view of another embodiment of the present invention illustrating how a sheet of material such as cardboard may be cut and folded into a container according to the present invention. This particular embodiment of the present invention utilizes a design whereby the sides defining the Top, 16, of the box fold inside of the sides defining the Bottom, 22, of the box when the box is closed. Further, this particular embodiment of the present invention incorporates additional perforations that facilitate folding of the Back Closing Tab 58 and the Front Closing Tab 46. FIG. 3 is a plan view of another embodiment of the present invention illustrating how a sheet of material such as cardboard may be cut and folded into a container according to the present invention. This particular embodiment of the present invention utilizes a design whereby the sides defining the Top, 16, of the box fold inside of the sides defining the Bottom, 22, of the box when the box is closed. Further, this particular embodiment of the present invention incorporates fewer perforations, which provide for a stronger overall first box structure. FIG. 4 is a plan view of another embodiment of the present invention illustrating how a sheet of material such as cardboard may be cut and folded into a container according to the present invention. This particular embodiment of the present invention utilizes a design whereby the sides defining the Top, 16, of the box fold inside of the sides defining the Bottom, 22, of the box when the box is closed. Further, this particular embodiment of the present invention does not utilize a Line of Perforation, 26, along the Cord, 50. FIG. 5 is a plan view of yet another embodiment of the present invention illustrating how a sheet of material such as cardboard may be cut and folded into a container according to the present invention. This particular embodiment of the present invention utilizes a design whereby the sides defining the Top, 16, of the box fold inside of the sides defining the Bottom, 22, of the box when the box is closed. Further, this particular embodiment of the present invention utilizes a Line of Perforation, 26, without a Cord, 50, to facilitate splitting the first box. FIG. 6 is a plan view of yet another embodiment of the present invention illustrating how a sheet of material such as cardboard may be cut and folded into a container according to the present invention. This particular embodiment of the present invention utilizes a design whereby the sides defining the Top, 16, of the box fold inside of the sides defining the Bottom, 22, of the box when the box is closed. In this particular embodiment of the present invention, a Line of Perforation, 26, is used along only one side of the Cord, 50. FIG. 7 is a plan view of yet another embodiment of the present invention illustrating how a sheet of material such as cardboard may be cut and folded into a container according to the present invention. This particular embodiment of the present invention utilizes a design whereby the sides defining the Top, 16, of the box fold inside of the sides defining the Bottom, 22, the box when the box is closed. In this particular embodiment, Removable Section D is reduced in size. FIG. 8 is a plan view of yet another embodiment of the present invention illustrating how a sheet of material such as cardboard may be cut and folded into a container according to the present invention. This particular embodiment of the present invention utilizes a design whereby the sides defining the Top B, 70, of the box fold outside of the sides defining the Bottom B, 82, of the box when the box is closed.

DETAILED DESCRIPTION OF THE INVENTION

The most preferable embodiment of the present invention utilizes a Pull-Tab 40, 94, connected to a Cord, 50, running against or within the box so that when the consumer pulls it, the Cord, 50, cuts or tears the box material similar to that found in the art and used to open some mailing containers. This weakens the structure of the box so that the box may easily be separated into two pieces. The Pull-Tab, 40, 94, allows the consumer to get a secure grip on the Cord, 50, in order to pull it. In the preferred embodiment the Pull-Tab, 40, 94, is defined by perforations of the box adjacent to the sides of the Cord, 50, and or at one end of the Cord, 50, but in other embodiments may include an additional piece of material attached to the Cord, 50, for the consumer to grip. The Cord, 50, may be made using any material of sufficient strength to tear the box material when pulled. Typically, the Cord, 50, is made of a plastic polymer material. In one preferred embodiment of the present invention, the Cord, 50, is made of polyethylene. In another preferred embodiment of the present invention, the Cord, 50, is made of a woven fibrous material. Several tear tape products are available on the market and some of these are suitable for use in this box structure. The box may be constructed of any material of sufficient strength for use as a pizza delivery container that may be cut or torn by the Cord, 50, material. In the preferred embodiment, the box is made of a corrugated paper cardboard material. In yet another embodiment, the corrugated paper material is coated with a water repellant substance such as wax or a plastic coating found in the art in order to maintain the freshness of the pizza leftovers. Further, in yet another embodiment, a microwave heating surface as found in the art may be attached to or built into the box material.

In order to function properly, the Cord, 50, must be securely attached to the box material. In one embodiment, polymer glue is used to attach the Cord, 50, to the box, but any means of sufficient strength known in the art may be used to attach the cord to the box, for example, pressure sensitive adhesive. In one particular embodiment, the Cord, 50, is attached to the inner surface of the box. In another particular embodiment, the Cord, 50, is attached to the outside surface of the box. In another particular embodiment, the Cord, 50, is inserted within the box material. In embodiments wherein the box is constructed of corrugated material, the Cord, 50, may run either parallel or perpendicular to the direction of corrugations. However, in the most preferable embodiment, the Cord, 50, runs perpendicular to the direction of the corrugations. In yet another embodiment, the Cord, 50, may comprise multiple layers, and be attached to both the inner and outer surface of the box. In yet another embodiment, the Cord, 50, may comprise multiple layers, and be attached to both the inner surface of the box and be inserted within the box material. In yet another embodiment, the Cord, 50, may comprise multiple layers, and be attached to both the outer surface of the box and be inserted within the box material.

Further, perforations may be added along either or both sides of the Cord, 50, in order to reduce the effort required to rip the box or to help generate smoother edges along the rip. These are illustrated in FIGS. 1-3 and 6-8 as Lines of Perforation.

The present invention may best be described by example. Eight preferred embodiments of the present invention are illustrated. In all illustrations, a solid line represents a cut. A line with large dashes represents folds in the box structure that are most preferably but not necessarily scored using perforations or cuts. Lines denoted by small dashes represent lines that are perforated or otherwise weakened so that the consumer may tear the box material along the line. Lines denoted by small dots represent latent fold lines along which the box is folded to close the open end of the split box. These lines may be denoted by perforations, indentations, or nothing, but perforations may not be necessary, particularly if the fold is parallel to the grain of the cardboard. Lines denoted by dashes perpendicular to the length of the box represent the location of the Cord, 50.

EXAMPLE 1

FIG. 1 is a plan view of one preferred embodiment of the present invention and illustrates how a sheet of material may be cut and folded according to the present invention. Lower Side Wall A, 24, along with Front Bottom Tab A, 30, and Back Bottom Tab A, 18, are together folded up towards the Bottom, 22. Front Bottom Tab A, 30, and Back Bottom Tab A, 18, are further folded towards the Bottom, 22, at an angle of substantially ninety degrees to Lower Side Wall A, 24. Lower Side Wall B, 48, along with Front Bottom Tab B, 42, and Back Bottom Tab B, 56, are together folded up towards the Bottom, 22. Front Bottom Tab B, 42, and Back Bottom Tab B, 56, are further folded towards the Bottom, 22, at an angle of substantially ninety degrees to Lower Side Wall B, 48. The Lower Front Wall, 34, is folded up towards the Bottom, 22, and is folded over Front Bottom Tab A, 30, and Front Bottom Tab B, 42. Upper Side Wall A, 14, Upper Front Wall, 12, and Upper Side Wall B, 62, are folded up towards the Top, 16, at essentially a ninety-degree angle. To complete the assembly of the first box, the Top, 16, is folded towards the Bottom, 22, using the Back Wall, 20, as a hinge. In this particular embodiment of the present invention, Upper Side Wall A, 14, Upper Side Wall B, 62, and the Upper Front Wall, 12, fold inside of Lower Side Wall A, 24, Lower Side Wall B, 48, and the Lower Front Wall, 34, as the box is closed.

After assembly, and in order to easily dispose of the box or prepare the box for storing leftovers, the consumer grasps the Pull-Tab, 40, and pulls the Cord, 50, following the Cord, 50, around the box as it is torn through, thereby ripping or cutting the box along the Cord, 50, line. The first box may then be separated into two portions. This particular embodiment includes Lines of Perforation, 26, along both sides of the Cord, 50. In the most preferable embodiment illustrated in FIG. 1, the Lines of Perforation include a section that can be more easily torn by the consumer along the Lower Front Wall, 34. In this most preferable embodiment, the perforations used in the section of the Lines of Perforation across the Lower Front Wall, 34, are similar to those used in other portions of the design such as around Removable Section B, 66. This facilitates reducing the effort required to pull the Cord, 50, through the box material in this area where the structure is doubled.

Once the box is separated into two pieces, both pieces may be disposed of directly, or alternatively, the open end of the large piece may be folded closed, forming a second sturdy container structure (a second box). The open end is folded shut as follows. Removable Section A, 36, Removable Section B, 66, and Removable Section C, 60, are torn out of the box along the perforations. The open edge of the Top, 16, is folded in towards the Bottom, 22, of the box along Latent Fold Line B, 64. The Front Closing Tab, 46, and the Rear Closing Tab, 58, are folded inwards towards the Bottom, 22, after separating them from the Lower Front Wall, 34, and Back Wall, 20, along the perforations.

From this point there are a few distinct ways of completing the closed box structure according to the preferences of the consumer. As one option the open edge of the Bottom, 22, with the Front Closing Tab, 46, and the Rear Closing Tab, 58, are folded in along Latent Fold Line A, 54. After folding them up to an angle of approximately ninety degrees relative to the Bottom, 22, the Front Closing Tab, 46, and Rear Closing Tab, 58, are released and allowed to pass through the openings in the folded edge of the Top, 16, created by Removable Section B, 66, and Removable Section C, 60. Once released and opened up into the inside of the second box structure, Closing Tab A and Closing Tab B securely lock the second box closed by preventing the folded open edge of the Bottom, 22, from unfolding. This optional folding method may be performed without the necessity of first opening the second box.

As a second option, the Front Closing Tab, 46, is inserted between the folded leaves of the Lower Front Wall, 34, as the open edge of the Bottom, 22, is folded up towards the Top, 16. The Back Closing Tab, 58, may then be opened into the second box as in the first option to complete the closing operation. In this example of a preferred embodiment of the present invention, one edge of the Front Closing Tab, 46, is angled by its proximity to the Pull-Tab, 40, which facilitates insertion between the leaves of the Lower Front Wall, 34. Other embodiments of the present invention may feature a Front Closing Tab, 46, without such an angle. This optional folding method may also be performed without the necessity of first opening the second box.

As a third option, the second box is first opened, then the open edge of the Bottom, 22, is folded up towards the Top, 16, and the Front Closing Tab, 46, and Rear Closing Tab, 58, are placed against the Front Wall and Rear Wall respectively. Folding the lid shut as in the completion of the first box finishes the closing operation. The consumer may devise other variations in the folding operation.

The reduced size container may now be opened and closed as needed in a manner similar to the original full size container. When closed, the reduced size container is very sturdy and can be used to store leftovers conveniently.

EXAMPLE 2

FIG. 2 is a plan view of another preferred embodiment of the present invention and illustrates how a sheet of material may be cut and folded according to the present invention. This particular embodiment is very similar to that illustrated by Example 1 and can be folded into a box structure in the same manner. In addition, this particular embodiment may be split into two pieces and the open end of the large piece may be folded into a sturdy closed secondary container in a manner similar to that described in Example 1.

In addition to the features described in Example 1, this particular embodiment includes additional foldable perforation means along the Front Closing Tab, 46, and Rear Closing Tab, 58. This further facilitates folding of the Front Closing Tab, 46, and Rear Closing Tab, 58, inwards toward the open edge of the Bottom, 22, while closing the second box.

EXAMPLE 3

FIG. 3 is a plan view of another preferred embodiment of the present invention and illustrates how a sheet of material may be cut and folded according to the present invention. This particular embodiment is very similar to that illustrated by Example 1 and can be folded into a box structure in the same manner. In addition, this particular embodiment may be split into two pieces and the open end of the large piece may be folded into a sturdy closed secondary container in a manner similar to that described in Example 1.

In addition to the features described in Example 1, this particular embodiment eliminates perforation means along one edge of the Front Closing Tab, 46, and Rear Closing Tab, 58, within Removable Section B, 66, and the perforation means along Latent Fold Line A, 54, ant Latent Fold Line B, 64. This further facilitates a stronger first box structure.

EXAMPLE 4

FIG. 4 is a plan view of another preferred embodiment of the present invention and illustrates how a sheet of material may be cut and folded according to the present invention. This particular embodiment is very similar to that illustrated by Example 1 and can be folded into a box structure in the same manner. In addition, this particular embodiment may be split into two pieces and the open end of the large piece may be folded into a sturdy closed secondary container in a manner similar to that described in Example 1.

However, in this particular embodiment, Lines of Perforation are not used along the sides of the Cord, 50.

EXAMPLE 5

FIG. 5 is a plan view of another preferred embodiment of the present invention and illustrates how a sheet of material may be cut and folded according to the present invention. This particular embodiment is similar to that illustrated by Example 1 and can be folded into a box structure in the same manner. However, this particular embodiment utilizes a Line of Perforation, 26, instead of a Pull-Tab, 40, Cord, 50, design in order to facilitate splitting the first box into two portions.

In order to split the first box into two portions, the box is manually torn along the Line of Perforation, 26. Once torn in this manner, the second box may be folded shut in a manner similar to that described in Example 1.

EXAMPLE 6

FIG. 6 is a plan view of another preferred embodiment of the present invention and illustrates how a sheet of material may be cut and folded according to the present invention. This particular embodiment is very similar to that illustrated by Example 1 and can be folded into a box structure in the same manner. In addition, this particular embodiment may be split into two pieces and the open end of the large piece may be folded into a sturdy closed secondary container in a manner similar to that described in Example 1.

In this particular embodiment a Line of Perforation, 26, is used along only one side of the Cord, 50. By utilizing the Line of Perforation, 26, alongside the Cord, 50, on the side corresponding to the larger portion of the split box, the Line of Perforation, 26, facilitates a cleaner torn edge on this side which facilitates a more finished appearance of the second box.

EXAMPLE 7

FIG. 7 is a plan view of another preferred embodiment of the present invention and illustrates how a sheet of material may be cut and folded according to the present invention. This particular embodiment is very similar to that illustrated by Example 1 and can be folded into a box structure in the same manner. In addition, this particular embodiment may be split into two pieces and the open end of the large piece may be folded into a sturdy closed secondary container in a manner similar to that described in Example 1, including folding options two and three.

This particular embodiment utilizes Removable Section D which is reduced in size. Therefore, the first folding option described in Example 1 will not work, but this box is most preferably folded according to the second option described in Example 1.

EXAMPLE 8

FIG. 8 is a plan view of another preferred embodiment of the present invention and illustrates how a sheet of material may be cut and folded according to the present invention. Lower Side Wall C, 80, along with Lower Front Tabs A1, 84, A2, 86, and A3, 88, are together folded up and in towards the Bottom B, 82. Similarly, Lower Side Wall D, 106, along with Lower Front Tabs B1, 100 B2, 98, and B3, 96 are together Folded up and in towards the Bottom B, 82. The Lower Front Wall B, 90, is attached to Lower Front Tabs A3, 88 and B3, 96. Through this connection, the folding of Upper Side Wall C, 72, and Upper Side Wall D, 112, pulls the Lower Front Wall B, 90, up into position. When folded properly, Lower Front Tabs A2, 86 and B2, 98 are folded over 180 degrees towards the Bottom B, 82. Upper Side Wall C, 72, Upper Side Wall D, 112, and the Upper Front Wall B, 68, are folded up and in towards the Top B, 70, into an angle of essentially ninety degrees. Upper Rear Tab A, 76, and Upper Rear Tab B, 108, are further folded in relation to Upper Side Wall C, 72, and Upper Side Wall D, 112, respectively into an angle of essentially ninety degrees. In order to complete the assembly of the first box, the Top B, 70, is folded towards the Bottom B, 82, using the Back Wall B, 74, as a hinge. In this particular embodiment of the present invention, Upper Side Wall C, 72, and Upper Side Wall D, 112, fold outside of Lower Side Wall C, 80, and Lower Side Wall D, 106, respectively. The Upper Front Wall B, 68, Folds inside of the Lower Front Wall B, 90, as the first box is closed.

In order to easily dispose of the box or prepare the box for storing leftovers, the consumer grasps the Pull-Tab B, 94, and pulls the Cord, 50, following the Cord, 50, around the box as it is torn through, thereby ripping or cutting the box along the Cord, 50, line. The box is then easily separated into two pieces.

Once the box is separated into two pieces, both pieces may be disposed of directly, or alternatively, the open end of the large piece may be folded closed, forming a second sturdy container structure (the second box). The open end is folded shut as follows. Removable Section A1, 92, Removable Section A2, 102, and Removable Section E, 78, are torn along the perforations and removed. The Front Closing Tab B, 116, and the Rear Closing Tab, 110, are folded inwards towards the Top B, 70, after separating them from the Upper Front Wall B, 68, and Back Wall B, 74, along the perforations. The open edge of the Bottom B, 82, is folded in along the Lower Latent Fold Line, 104, towards the Bottom B, 82, into an angle of essentially ninety degrees. The open edge of the Top B, 70, is then folded in along Upper Latent Fold Line, 114, along with the Front Closing Tab B, 116, and the Rear Closing Tab, 110, to an angle of approximately ninety degrees relative to the Top B, 70. The Front Closing Tab B, 116, and the Rear Closing Tab, 110, are opened so that they are approximately parallel to the Lower Front Wall B, 90, and Back Wall B, 74, respectively. This completes the closing of the second box. This folding method may be performed without the necessity of first opening the second box. The consumer may devise other variations in the folding operation.

The reduced size container may now be opened and closed as needed in a manner similar to the original full size container. When closed, the reduced size container is very sturdy and can be used to store leftovers conveniently.

The Lines of Perforation may be comprised of any perforation found in the art. In one particular embodiment, the Lines of Perforation are comprised of elongated perforations situated at an angle between zero and ninety-degrees in relation to the Cord 50. In yet another particular embodiment, the Lines of Perforation are comprised of perforations that include two elongated cuts situated at essentially ninety-degrees to one another, one cut parallel to the Cord, 50, and joined to one another in order to essentially generate a single perforation. In the most preferable embodiment the elongated cut perpendicular to the Cord, 50, is shorter than the elongated cut parallel to the Cord, 50. The use of this type of perforation beside and parallel to the Cord, 50, results in an extraordinarily clean edge after splitting the box in two.

Each of the boxes depicted in the illustrations are simply examples of preferred embodiments of the present invention. Many other specific designs are possible without departing from the spirit and scope of the present invention. The location of the Cord, 50, May be moved in order to change the size or volume of the pieces of the split box. Means for closing the open end similar to that disclosed in the illustrations may be added to both pieces of the split box instead of only one piece. Additionally, many minor changes may be made and details added to the box structure by those skilled in the art without departing from the spirit and scope of the present invention. Examples include but are not limited to: cuts or perforations along fold lines, small tabs designed to lock folded pieces in position, changes to the angle of certain edges to facilitate folding or closing, and changes to the relative scale of the parts of the structure. Each of these changes and details are commonly added to box structures by those skilled in the art.

The present invention has several key advantages when compared to the prior art. First, the utility of the box as a delivery vehicle is not compromised because the structural integrity of the box is not significantly weakened until the consumer chooses. Once the consumer chooses, the box is easily broken into two conveniently disposable pieces. Second, the open end of one or both portions of the split box may be folded shut forming a sturdy storage container (the second box). Third, the present invention achieves its utility while retaining a simple design that is easy to use and economical to manufacture.

Only those limitations disclosed herein should be used to limit the spirit and scope of the present invention.

We claim:

1. A fully re-closable, size selectable container system structure, comprising a. a bottom portion, the perimeter of which is defined by hingedly attached, opposing lower side walls, a hingedly attached back wall, and a hingedly attached lower front wall b. a top portion hingedly attached to said back wall, the perimeter of which is defined by hingedly attached, opposing upper side walls, a hingedly attached upper front wall, and said hingedly attached back wall c. divisional means for facilitating the division of the container system structure into at least two pieces, arranged longitudinally through the container system structure d. a back wall tab portion on the back wall adjacent to the divisional means, delineated by perforations and said divisional means, essentially rectangular in shape, removably attached to the back wall, hingedly attached to the bottom portion and having a length essentially equal to the height of the back wall and a width essentially equal to or lesser than the height of the back wall e. a removable portion on the lower front wall, adjacent to the divisional means, delineated by perforations and said divisional means, extending to the edge of the container system structure and having a length essentially equal to or greater than half the width of the lower front wall, and a width essentially equal to or less than half the width of the lower front wall f. a removable portion of the upper front wall, adjacent to the divisional means, delineated by perforations and said divisional means, extending to the edge of the container system structure on the upper front wall and having a width essentially equal to or less than half the width of the lower front wall g. a removable portion on the top, adjacent to the divisional means and the back wall, delineated by perforations and said divisional means, adjacent to the back wall tab portion and having a length essentially equal to or greater than the length of the back wall tab portion and a width essentially equal to or less than the height of the back wall h. a tab portion on the lower front wall, adjacent to the divisional means, delineated by perforations and said divisional means, the bottom portion and the removable portion on the lower front wall having a width and length essentially equal to or less than half the width of the lower front wall.

2. A container system structure according to claim 1, wherein the divisional means for dividing the container system structure comprises a cord.

3. A container system structure according to claim 1, wherein the divisional means for dividing the container system structure comprises perforations.

4. A container system structure according to claim 1, wherein the lower side walls include hingedly attached tabs adjacent to the lower front wall and adjacent to the back wall.

5. A container system structure according to claim 1, wherein the lower front wall folds over itself, forming a double walled structure.

6. A container system structure according to claim 2, wherein said divisional means further comprises perforations arranged parallel and adjacent to the cord to aid in tearing of the container system structure.

7. A container system structure according to claim 1 wherein the divisional means comprises a. a cord b. a pull-tab associated with said cord.

8. A container system structure according to claim 1, wherein the divisional means comprises a single row of perforations.

9. A container system structure according to claim 1, wherein the divisional means comprises multiple rows of perforations essentially parallel to one another.

10. A container system structure according to claim 7, wherein the divisional means further comprises two rows of perforations arranged adjacent to and essentially parallel with one side the cord.

11. A container system structure according to claim 7, wherein the divisional means further comprises two rows of perforations arranged one on each side of and essentially parallel to the cord.

12. A container system structure according to claim 1, wherein the inside surface of the container system structure is coated with a waterproofing substance.

13. A fully re-closable, size selectable container system structure comprising a. a bottom portion, the perimeter of which is defined by hingedly attached, opposing lower side walls, a hingedly attached back wall, and a hingedly attached lower front wall b. a top portion hingedly attached to said back wall, the perimeter of which is defined by hingedly attached, opposing upper side walls, a hingedly attached upper front wall, and said hingedly attached back wall c. divisional means for facilitating the division of the container system structure into at least two pieces, arranged longitudinally through the container system structure d. a back wall tab portion on the back wall adjacent to the divisional means, delineated by perforations and said divisional means, essentially rectangular in shape, removably attached to the back wall, hingedly attached to the top portion and having a length essentially equal to the height of the back wall and a width essentially equal to or lesser than the height of the back wall e. a removable portion on the lower front wall and bottom, adjacent to the divisional means, delineated by perforations and said divisional means, extending to the edge of the container system structure and having a length essentially equal to twice the width of the lower front wall, and a width essentially equal to or less than the width of the lower front wall f. a tab portion on the upper front wall, delineated by perforations and said divisional means, extending to the edge of the container system structure on the upper front wall, hingedly attached to the top, removably attached to the upper front wall and having a width essentially equal to or less than half-the width of the lower front wall, and a length essentially equal to or greater than the width of the lower front wall g. a removable portion on the bottom, adjacent to the divisional means and the back wall, delineated by perforations and said divisional means, adjacent to the back wall tab portion and having a length essentially equal to or greater than the length of said back wall tab portion and a width essentially equal to or less than the height of the back wall, wherein the lower front wall and the lower side walls are hingedly attached to one another through a triangular portion hingedly attached to the bottom portion.

* * * * *